United States Patent [19]

Parduhn et al.

[11] 4,032,248

[45] June 28, 1977

[54] ARTICULATED HIGHWAY DELINEATOR POST

[76] Inventors: Alfred P. Parduhn, 14501 Wilson Road, Oklahoma City, Okla. 73110; Waldo E. Cecil, P.O. Box 5314, Arlington, Tex. 76011

[22] Filed: Nov. 18, 1976

[21] Appl. No.: 742,856

[52] U.S. Cl. ..... 404/10; 256/DIG. 2; 40/145 A

[51] Int. Cl.[2] ..... E01F 9/00

[58] Field of Search ..... 404/9, 10; 256/DIG. 2; 40/145 A

[56] References Cited

UNITED STATES PATENTS

| | | | |
|---|---|---|---|
| 266,453 | 10/1882 | Fogus | 256/DIG. 2 |
| 413,088 | 10/1889 | Payne | 256/DIG. 2 |
| 446,852 | 2/1891 | Davis | 256/DIG. 2 |
| 633,497 | 9/1899 | Zickefoose | 256/DIG. 2 |
| 1,293,612 | 2/1919 | Magley | 256/DIG. 2 |
| 2,085,074 | 6/1937 | Boyles | 404/10 X |
| 3,279,133 | 10/1966 | DeKorte | 404/10 X |
| 3,438,311 | 4/1969 | Remek | 404/10 |
| 3,521,917 | 7/1970 | King | 404/10 X |
| 3,792,680 | 2/1974 | Allen | 404/145 A X |
| 3,875,720 | 4/1975 | Russell | 40/145 A X |

*Primary Examiner*—Nile C. Byers, Jr.
*Attorney, Agent, or Firm*—William R. Laney

[57] ABSTRACT

An articulated highway delineator post assembly which includes an elongated, vertically extending indicator support post telescopingly engaged with a resilient slotted tubular sleeve. The support post is connected to the sleeve by a pivot pin assembly allowing pivotal movement of the support post about a horizontal axis to project a portion of the support post through the slot in the sleeve. The slot in the resilient sleeve is dimensioned in relation to the dimension of the support post to continuously resiliently urge the support post toward a vertical position when it has been inclined from the vertical at an acute angle upon pivotation and extension through a portion of the slot. The assembly further includes a ground post extended into the earth and projected at its upper end into one end of the tubular sleeve for supporting the sleeve and the support post above, and in substantially vertical alignment with, the ground post.

22 Claims, 11 Drawing Figures

ARTICULATED HIGHWAY DELINEATOR POST

BACKGROUND OF THE INVENTION

1. Field of the Invention

This invention relates to highway delineator posts, and more particularly, to posts which are constructed to facilitate a breakover motion of an upper portion of the post upon impact by an automobile or other errant vehicle, so that damage to the vehicle and also to the delineator post is minimized.

2. Brief Description of the Prior Art

Highway delineator posts in current use generally include an elongated upright post structure susceptible to damage or destruction when struck by an errant automobile or other vehicle. The posts are generally constructed of metal, and are so severely bent upon impact by an automobile that repair by straightening, followed by relocation, is generally uneconomical, and the posts, after suffering such damage, are sold for scrap metal. The alternative to repair is replacement by a new post which is, of course, costly.

In an attempt to obviate the need for complete replacement and to reduce destruction, or the severity of damage, a number of articulated delineator post structures have ben proposed which breakover or yield under impact. There have also been proposed several types of delineator posts having frangible sections which shear away under impact, but such devices still do not avoid or overcome the need for replacement, but merely are helpful in reducing the damage sustained by the automobile upon striking the delineator post.

One type of articulated structure which relies upon yielding or pivoting of an upper section of the post by the bending of a connecting bolt is that structure shown in Katt U.S. Pat. No. 3,820,906. In the Katt structure, impact to the upper portion of the post results in severance of a frangible plate along a shear line, followed by elongation and bending of a bolt used in supporting the uper portion of the post on a ground post or a lower section of the delineator post. It will be apparent that this structure, while yielding under impact and permitting less damage to be sustained by the upper portion of the post which is struck by the vehicle, nevertheless, requires repair and even replacement of certain portions of the articulation-affording portions of the post before the upper portion of the post can be placed back in service.

A breakaway sign post for use along highways is disclosed in King U.S. Pat. No. 3,521,917 and employs, in reducing damage to the sign post and to the automobile, a pair of yieldable, gripping side plates which are extended from the upper portion of the post over the opposite sides of a ground post, and which frictionally engage the ground post during the normal operating status of the post. When the upper portion of the post is impacted by an errant vehicle, the side plates can yield outwardly from each other to accommodate a pivoting motion of the upper portion of the post in which it is moved out of the vertical plane under the force of impact. Under severe impact, the upper portion of the post can be completely separated from the ground post upon which it is mounted. It will be perceived in referring to the King patent that an impact of an severity will sufficiently displace the upper portion of the post and that realignment and resetting of the upper portion of the post on the ground post is required before the sign post can be restored to operational status.

An example of a structural delineator post assembly which operates on the principle of the upper portion of the post being completely sheared away from a ground post and interconnecting coupling is that which is illustrated in Henry U.S. Pat. No. 3,628,296.

Yet another principle is illustrated in West German Pat. 1,459,830 where a plurality of snap-engaging brackets carried on an upper portion of a delineator post snap over a flange or plate carried at the upper side of the ground post and simply retain the upper portion of the post in vertical alignment with the ground post by a frictional snap-engagement. Impact imparted to the upper portion of the post will overcome the snap-engaging action of the brackets to completely release the upper portion of the post from the ground post. For reinstallation and restored service of the post assembly, it is then necessary for workmen to realign the spring-engaging brackets with the flange, and force the upper portion of the post downwardly until snap-engagement reoccurs. This assumes that the spring brackets are not distorted or bent when they are forced to yield by the sudden impact imparted to the upper portion of the post.

Other types of yieldable section or articulated highway post structures are shown in West German Pat. No. 1,255,128, Swiss Pat. No. 367,091, and Gubela U.S. Pat. No. 3,451,319.

In a different context, it is sometimes desirable to provide an articulated post structure, such as a flag pole, where the top end of a vertically extending pole can be made accessible by pivoting the top portion of the pole downwardly in relation to a ground post or anchoring structure to which it is pivotally secured when in use. Such structures, as previously proposed, which have included flag poles, are shown in Allen U.S. Pat. No. 3,792,680 and Crum U.S. Pat. No. 1,575,040. A fishing pole holder utilizing this general principle is shown in Hoover U.S. Pat. No. 3,539,080.

The Hoover fishing pole holder provides, through the use of resilient, inwardly curving clamping jaws in a tubular member retaining a pivoted portion of a fishing pole, a resilient snap-action which tends to snap the pivoted part of the pole into a position of axial alignment with the socket in which this part of the pole is mounted. This principle has not, however, been carried over or applied to any form of highway delineator post, and would actually be unsatisfactory for use in such application without the addition of some further structure making the pole and spring jaws (spring tubular member engaging the pole) compatible with a ground post to which the tubular member would be attached.

The highway delineator post structures hereinbefore described, and illustrated in the various patents referred to, while affording advantages over rigid posts which will not yield upon impact without destruction and severe damage to the automobile, nevertheless do not, in any instance, function in a way which minimizes or completely alleviates damage to the upper portion of the pole, and permits quick restoration to an operative status by unskilled workmen in a short period of time. In general, the prior art has not obviated the necessity for replacing or repairing the posts after high speed vehicle impact therewith. It therefore remains desirable to provide a highway delineator post which functions effectively as a marker and delineator along a highway, yet also reduces or elinimates the necessity for costly replacement or repair.

BRIEF DESCRIPTION OF THE PRESENT INVENTION

The present invention contemplates an articulated delineator post assembly in which an elongated indicator support post is movably retained in a tubular sleeve by which it is joined to a permanent ground post, and by reason of its pivotal connection to the sleeve, can be pivoted from a vertically extending position to a position where it extends horizontally to, or is inclined into contact with, the ground. The construction of the sleeve is such that pivotal movement of the indicator support post from its vertically extending status, under displacing impact from an errant vehicle, is resiliently resisted, and a tendency exists, during the phase of movement of the support post in which it is inclined to the vertical, to resiliently bias the support post back to its vertical position. This action enables the indicator support post to be manually returned, or, in the case of some embodiments which employ spring or resiliently biased assistance, automatically returned, to its operational vertically extending position after being knocked down by a colliding vehicle.

Broadly described, the articulated delineator post assembly of the invention comprises a vertically extending elongated indicator support post adapted to have a road sign, or other indicating indicia, affixed to its upper end, and a vertically slotted tubular sleeve which is pivotally connected to the lower end of the indicator support post to facilitate pivotation of the support post about a horizontal axis, and extension, during such pivoting movement, through the slot in the sleeve. The tubular sleeve is geometrically adapted to engage the upper end portion of an earth-penetrating ground post, and the sleeve is constructed of a resilient material, which characteristic, in combination with the dimension of the slot therein and the geometric configuration of the sleeve, enables the sleeve to exert a resilient restoring bias on the indicator support post after it has been displaced from its normal operational position as a result of impingement of a moving vehicle thereagainst.

In an alternate embodiment of the invention, the sleeve can be slotted on opposite sides to permit the indicator support post to pivot downwardly in either of two opposite directions from its vertically extending status.

It is an object of the present invention to provide an indicator post which can pivot in a vertical plane and about a horizontal axis near one end of the indicator post when the post is subjected to impact by a moving object, such as a vehicle.

It is a further object of the invention to provide an indicator post for use along roadways, which post is yieldable without destruction or distortion of any of the structural elements thereof, so that impact, denting or damage to the post resulting from a vehicle striking the post is reduced or eliminated due to such yielding capability.

It is yet another object of the invention to provide an indicator post which reduces maintenance and replacement costs normally experienced in the use of such delineator posts, and which is characterized by its resistance to damage from vehicles, and by its susceptibility to being restored quickly and easily to an operating status by one person, and without the use of special tools or replacement parts. In the case of some embodiments utilizing spring assistance, the restoration of the post to operational status occurs automatically.

A further object of the invention is to provide a highway delineator post which has only one moving part, and only three major components, and is therefore relatively economical to construct and maintain, which delineator post requires no periodic maintenance or servicing, and which is characterized in having an unusally long operating life under the usual or more extreme conditions encountered in using such posts for marking and delineating roadways and the like.

Other objects and advantages of the invention will become evident from the following detailed description of a preferred embodiment of the invention when such description is considered in conjunction with the accompanying drawings which illustrate such preferred embodiment.

DETAILED DESCRIPTION OF A PREFERRED EMBODIMENT OF THE INVENTION

Figure 1:
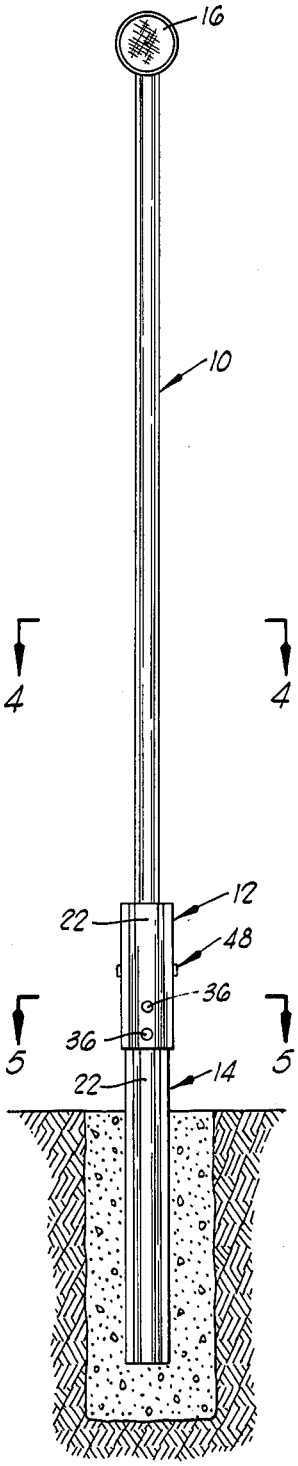
FIG. 1 is a side elevation view of the delineator post assembly of the invention as it appears from that side thereof which faces a highway or roadway.
Figure 2:
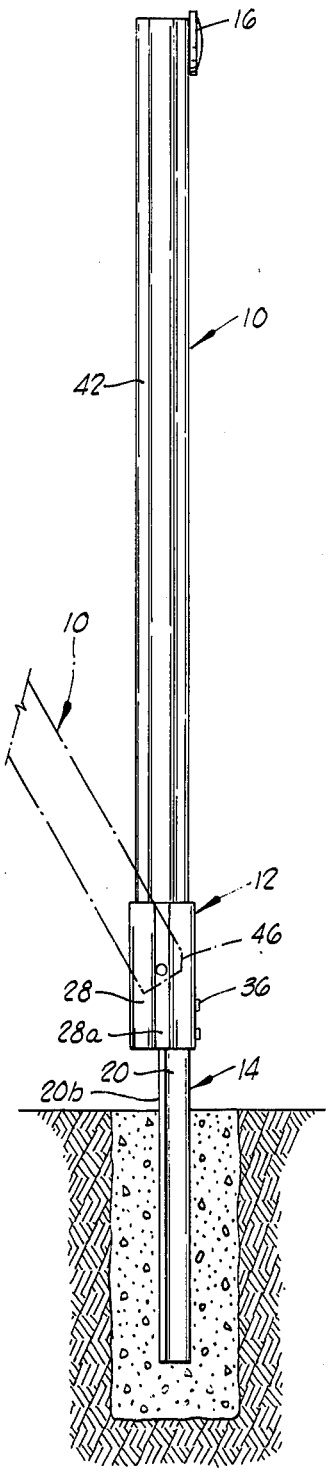
FIG. 2 is a side elevation view of the delineator post assembly depicted in FIG. 1, with the assembly rotated 90° from its position in FIG. 1, and depicting, in dashed lines, an alternate position of an indicator support post forming a part of the invention after this post has been displaced by impact from an automobile.

Referring initially to FIGS. 1 and 2 of the drawings, the articulated delineator post assembly of the invention is shown therein and includes, as major structural elements of the assembly, an elongated, vertically extending indicator support post, designated generally by reference numeral 10, a slotted tubular sleeve 12 connected to the lower end of the support post 10, and a ground post, designated generally by reference numeral 14, having an upper end connected to the slotted tubular sleeve 12. Highway delineator posts are generally erected alongside highways or streets along curves or other locations, for delineating the curve or, in some instances, carrying visible signs or other indicia at the upper end of the delineator post to apprise motorists of a condition of danger, or as a means of traffic flow and control. Frequently such delineator posts carry a small reflector at the upper end thereof, and such a reflector 16 is illustrated in FIG. 1.

The ground post, in the simplest form of highway delineator post heretofore utilized, has simply been a single steel or aluminum shaft or rod of varying cross-section which has its lower end driven into the earth or set in concrete, and extending upwardly to the full height of the delineator post. The rules and specifications of various highway departments and road maintenance organizations may specify, in some instances, the cross-sectional configuration which shall characterize such ground posts, with thought being given in such instances to configuring the cross-section of the ground post to impart sufficient mechanical strength and resistance to bending thereof to prevent vandals from manually bending or disfiguring the post.

Figure 5:
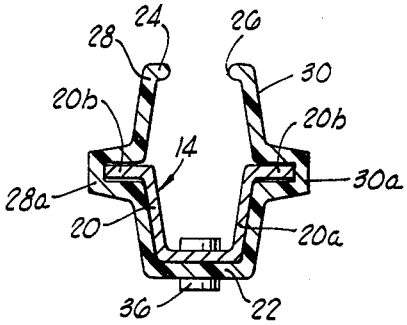
FIG. 5 is a sectional view taken along line 5—5 of FIG. 1.

In the illustrated embodiment of the present invention, a ground post 14 is substantially shorter than the conventional unitary one-piece delineator post structures described, and includes a metallic member 20 having the cross-sectional configuration as shown in FIG. 5. The member 20 thus includes a generally U-shaped web portion 20*a* having a pair of outwardly turned, oppositely directed flanges 20*b* secured to the legs of the web portion, and flaring outwardly therefrom. The ground post 14 is driven into the earth or set in concrete so that from about 4 to 10 inches of the ground post projects above the surface of the ground.

Figure 3:
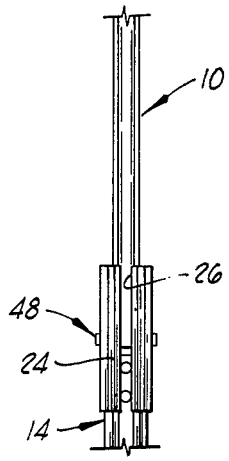
FIG. 3 is a detail view of a portion of the back side of the delineator post assembly (opposite the side shown in FIG. 1), and illustrating the slotted construction of the sleeve forming a part of the assembly.

The tubular sleeve 12 is illustrated from different angles in the several views of the drawings, and includes a first or forward wall 22 which is positioned on the opposite side of the tubular sleeve 12 from a vertically slotted back wall 24. The vertical slot 26 formed in the back wall 24 extends over the entire length of this wall, as shown in FIG. 3. The front wall 22 and slotted back wall 24 are interconnected by a pair of spaced, longitudinally channeled side walls 28 and 30. Each of the side walls has a longitudinally extending crenulation or protuberance 28*a* and 30*a* formed centrally therein and over the length thereof. The crenulations or protuberances 28*a* and 30*a* define elongated channels 32 and 34 within the tubular sleeve 12 on opposite sides thereof. It will be noted in referring to FIGS. 4 and 5 that those portions of the side walls 28 and 30 which extend between the protuberant portions 28*a* and 30*a* and the slotted back wall 24 are convergent with respect to each other.

In referring to FIG. 5 of the drawings, it will be perceived that the tubular sleeve 12 is joind to the ground post 14 by telescoping the tubular sleeve over the upper end of the ground post, so that the web portion 20*a* of the metal member 20 mates with the hollow interior of the tubular sleeve as formed, in part, by portions of the side walls 28 and 30 and by the front wall 22. The flanges 20*b* of the metal member 20 of the ground post slide into the channels 32 and 34 formed within the protuberant portions 28*a* and 30*a* in the side walls of the sleeve. It will thus be perceived that firm interlocking engagement is provided between the tubular sleeve 12 and the ground post 14, preventing rotation of the ground post, and also providing, by the configuration of the mating parts, mechanical reinforcement and enhanced strength to the lower portion of the sleeve which closely engages over the several angulations of the upper part of the ground post.

Sliding or relatively longitudinal movement between the ground post 14 and the tubular sleeve 12 is prevented by extending rivets 36, or other suitable fastening members, through the front wall 22 of the sleeve and through the web portion 20*a* of the metal member 20 of the ground post. It should be here pointed out that in some highway systems, the type of ground post in use may be of different cross-sectional configuration from that illustrated in the present application. The ground post may, for example, be primarily U-shaped in cross-sectional configuration, or it may be T-shaped in configuration, or, in less preferred forms, can be round, square or rectangular in cross-section. It is also possible, within the most basic principles of the invention, to use other means than the rivets 36 for preventing the sleeve 12 from sliding down on the post 14. In general, we prefer that the tubular sleeve 12 include at least a portion of its total cross-sectional configuration which will mate with, and slidingly receive, the ground post in use, regardless of the particular or specific cross-sectional configuration of the ground post.

The vertically extending elongated indicator support post 10 is a tubular member which, in a preferred embodiment of the invention, is constructed of a synthetic resin having a high degree of resilience and high impact strength. Other, less preferred, materials of construction can also be employed, and it is also possible to use solid, rather than hollow or tubular, indicator support posts.

Figure 4:
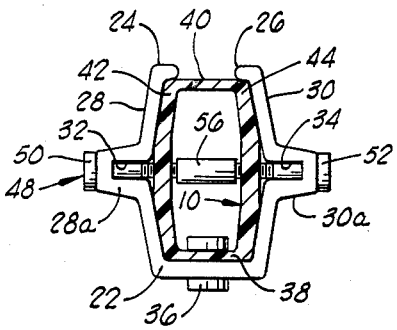
FIG. 4 is a sectional view taken along line 4—4 of FIG. 1.

It will be noted, in referring to FIG. 4, that the cross-sectional configuration of the indicator support post 10 mates with the interior cross-sectional configuration of the tubular sleeve 12, except for the channels 32 and 34 formed within the sleeve. Thus, the indicator support post 10 includes a front wall 38, back wall 40 and a pair of opposed side walls 42 and 44 which interconnect the front and back walls. Moreover, it will be noted that the side walls 42 and 44 are convergent with respect to each other from a medial plane extended longitudinally through the side walls to their lines or joinder to the back wall 40.

It will be further noted, in referring to FIGS. 2 and 3, that the lower end of the indicator support post 10 is spaced above the upper end of the ground post 14, and that one lower corner of the support post, which is adjacent the front wall 22 of the tubular sleeve 12, is relieved or cut away on a bias as shown at 46 in FIG. 2. These characteristics of the construction of the delineator post assembly facilitate the pivotation of the indicator support post 10 from the vertical, and in reference to the tubular sleeve 12, in a manner and for a purpose hereinafter described.

As a final element of the delineator post assembly of the invention, a pivot pin subassembly, designated generally by reference numeral 48, is employed for pivotally supporting the elongated indicator support post 10 in the tubular sleeve 12. The pivot pin subassembly 48 used in the illustrated embodiment is a blind rivet structure in which rivets 50 and 52 are extended through openings formed in the protuberant portions 28*a* and 30*a* of the side walls 28 and 30 of the sleeve 12, and through aligned or registering apertures or openings formed in the side walls 42 and 44 of the support post 10. The rivets so extended inwardly from opposite sides of the sleeve 12 are joined through a suitable internally threaded nut 56 which is disposed inside the lower end of the support post 10. It will be appreciated that various types of fastening devices can be used to effect the desired pivotal connection, and the particular type of pivot pin subassembly here illustrated and described is merely exemplary of various types which can be effectively utilized.

The manner in which the delineator post functions is, during normal use, to mark the side or edge of a highway or road at a curve by supporting the reflector element at a visible location along the side of the road, or to support an indicia-carrying sign at the upper end of the vertically extending, elongated support post 10. In such normal usage, the support post 10 extends in a vertical plane, and is in axial and longitudinal alignment with the tubular sleeve 12 and the ground post 14.

For various reasons and at random times, motor vehicles driven along the highway may swerve, or control of the vehicle may be lost, with the result that the vehicle is driven against the delineator post assembly. At this time, a high distorting force is imparted to the delineator post assembly, and the point of impact is most frequently at some point intermediate the ends of the vertically extending indicator support post 10. The bending or displacing movement thus imparted to the support post 10 forces it out of its normal, vertically extending position and, in general, the direction of application of the distorting force is either directly outwardly from the highway (that is, normal to the post as it is viewed in FIG. 1), or at some angle of from, say 10° to 80° with respect to a plane extended through, and including, the channels 32 and 34 in the side walls 28 and 30.

In any of these directions of approach, the direction of displacement of the indicator support post 10 upon impact is toward the slotted back wall 24 of the tubular sleeve 12. At this time, the support post 10 becomes inclined to the vertical, and proceeds to pivot through the vertically extending slot 26 formed in the back wall 24 in the manner illustrated in dashed lines in FIG. 2 of the drawings. In order for the post 10 to be pivoted through the slot 26, the edges of the back wall 24 which define the slot 26 must be forced away from each other, which in turn requires that the convergent portions of the side walls 28 and 30 be forced apart. The inherent resiliency of the high impact strength, high resilience synthetic resin material of which the sleeve 12 is constructed, yieldingly resists this pivoting movement of the post 10, and it will also be perceived that the pivoting movement is increasingly resisted by the flaring or the merging characteristic of the walls 42 and 44 in respect to their progressive movement into and through the slot 26. This is especially significant where the support post 10 is constructed of a resilient material in accordance with a preferred construction of the invention.

Where the impact to the indicator support post 10 has been severe, and the force tending to displace the post high, the post may be knocked all the way to a location where its upper end carrying the reflector 16 rests upon the ground. At this time, the edge portions of the back wall 24 which define the vertically extending slot 26 will bear against the flat portions of the side walls 42 and 44 of the support post, and will have been sprung apart to their most divergent or spaced positions.

After the operational status of the articulated delineator post assembly of the invention has been temporarily terminated by collision or impact by an automobile or other object, the indicator support post 10, which normally will not be bent or fractured, can be returned to its operative status quite easily. This restitution of the structure is accomplished manually by a single person by simply lifting the outer free end of the support post 10 upwardly to pivot the post back through the vertically extending slot 26, and into a position in which the opposed portions of the back wall 24 which define this slot snap over and engage the outwardly facing surface of the back wall 40 of the post 10. Return of the support post 10 to its vertically extending position is facilitated where the resilient biasing action comes into play as the post approaches vertically, and the propensity of the resilient material of construction of the sleeve 12 to be returned to its molded and relaxed status, wedges or biases the support post in a direction such that it is pivoted upwardly about the horizontal axis constituted by the pivot pin subassembly 48. Thus, it can be seen that it is unnecessary to replace any part of the delineator post assembly in most of those instances where the assembly has been struck by an errant automobile.

Occassionally, the force of impact will be sufficiently great and occur at an angle such that the support post 10 may be sheared off, or at least made to bend to some extend. In such instances, it is not difficult to replace this portion of the articulated delineator post assembly by simply attaching a new support post in the tubular sleeve 12 by a pivotal connection of the type described. Even should the tubular sleeve 12 be damaged by impact, it is very easy to quickly replace both the sleeve 12 and support post 10 on the ground post 14 which, under almost any circumstances, will remain intact and unaffected by any collisions in which the point of contact is at bumper level or higher on the colliding automobile.

It should finally be pointed out that even in those instances in which an automobile may have swerved off the road, and be running substantially parallel to the shoulder, and thus proceeding on a course to strike the support post 10 directly on one of the side walls 42 or 44, the resilience of the tubular sleeve 12 and of the support post 10, in the preferred construction of the invention, will prevent severe damage to the automobile and will, in these instances, also leave the ground post 14 intact for reuse in the reconstructed assembly following replacement of the sleeve and support post.

Certain alternate or modified embodiments of the invention are shown in FIGS. 6–10. In each of these modified structures, identical reference numerals have been used to designate parts which are identical to parts appearing in the embodiment of the invention shown in FIGS. 1–5.

Figure 6:
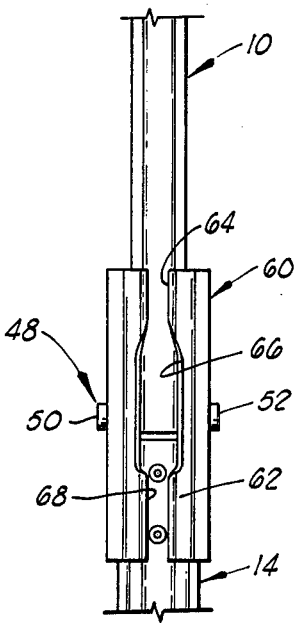
FIG. 6 is a detail view similar to FIG. 3, but illustrating an alternative embodiment of the invention.

In FIG. 6, the delineator post assembly includes the elongated, vertically extending indicator support post 10 and the ground post 14. A tubular sleeve 60 utilized in the embodiment of the invention shown in FIG. 6 is, however, modified to include an elongated slot extending from top to bottom of the sleeve in the back wall 62 of the sleeve. This slot provided in the sleeve at this location includes a neck portion 64 of relatively narrow transverse width, a central portion 66 which is substantially wider than the neck portion 64 and is joined thereto by tapered, interconnecting surfaces, and a lower portion 68 which is of about the same transverse width as the neck portion 64 and communicates with the central portion 66. In all other respects, the embodiment of the invention depicted in FIG. 6 is identical to that shown in FIGS. 1–5.

In use, the embodiment of the invention shown in FIG. 6 affords some advantage in that, upon impact of the indicator support post 10, causing it to pivot about its pivotal axis where it is supported by the rivets 50 and 52 of the pivot pin subassembly 48, the elongated support post 10 will be pivoted downwardly through the neck portion 64 of the slot and into the central portion 66 thereof. When the post 10 pivots into the central portion 66 of the slot where the transverse width of the slot is relatively large, distortion of the sleeve 60 due to the necessity for the slot to yield to permit the post to pivot down through the narrow neck portion 64 thereof is relieved, and the sleeve 60 can assume more nearly its normal undistorted and unstressed configuration. This feature tends to prolong the total service life of the sleeve, and prevents fatigue of the resilient material of the sleeve when a long period of time elapses before a highway crew can effect restoration of the support post 10 to its vertically extending position.

Figure 7:
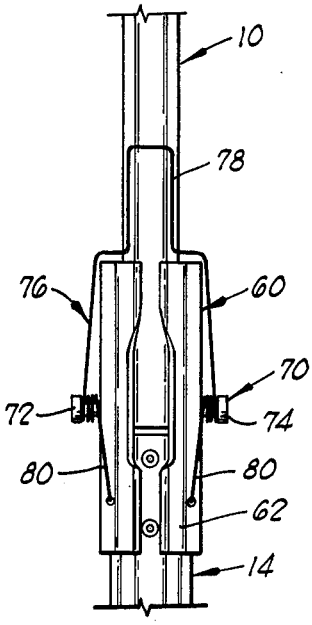
FIG. 7 is a detail view similar to FIGS. 3 and 6, but illustrating yet another embodiment of the invention.

In FIG. 7 of the drawings, a further modification of the structure of the invention is illustrated. Here, as in FIG. 6, the support post 10 and the ground post 14 are joined by a slotted sleeve 60 in which the slot is variable in its transverse width in the same manner as described in referring to FIG. 6, and extends from the upper end to the lower end of the back side 62 of the sleeve. A different type of pivot pin subassembly 70 is, however, here utilized. A pinning structure is employed in which opposed pivot pins 72 and 74 are characterized in having a portion of the shaft of each of these pins projecting outwardly from the side walls of the sleeve 60. There is thus provided an accommodating space about which can be coiled several convolutions of a restoration spring structure designated generally by reference numeral 76. The restoration spring structure 76 includes a bight portion 78 which bears resiliently against the support post 10 at a location spaced just above the upper end of the sleeve 60. The bight portion 78 is joined through the convolutions which surround the exposed shaft portions of the pivot pins 72 and 74 to bracing ends 80, which ends of the restoration spring bear against the outer sides of the protuberant portions of the side walls of the sleeve 60.

In operation, the embodiment of the invention depicted in FIG. 7 performs and operates substantially identically to that shown in FIG. 6. The restoration spring assembly 76, however, affords a substantial aid in restoring the support post 10 to its vertically extending position after it has been forcibly knocked downwardly by impact thereupon by an automobile. This aid to restoration is significant where the stiffness of the material of which the sleeve 60 is constructed makes upward pivotation of the displaced support post difficult.

Figure 8:
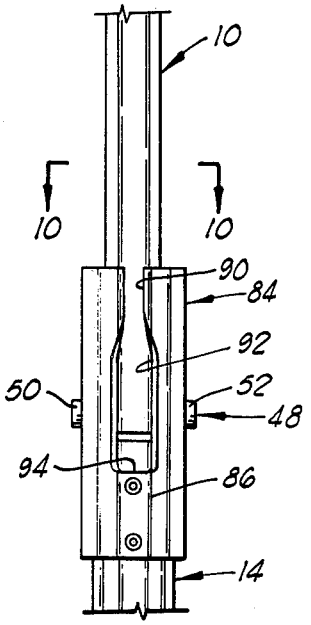
FIG. 8 is a detail view, similar to FIGS. 3, 6 and 7, but illustrating yet another embodiment of the invention.
Figure 9:
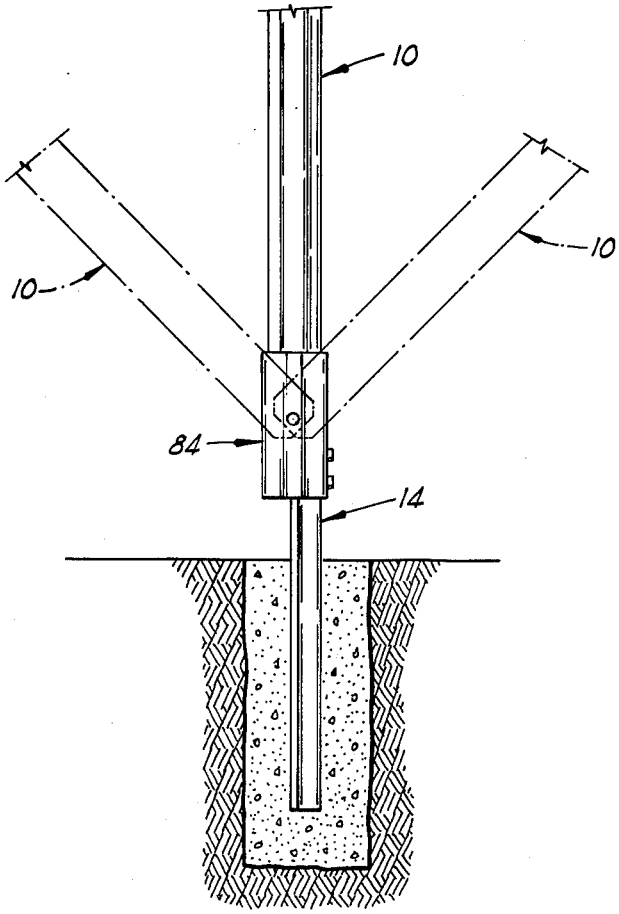
FIG. 9 is a side elevation view of a delineator post assembly incorporating the structure of the modified embodiment illustrated in FIG. 8.
Figure 10:
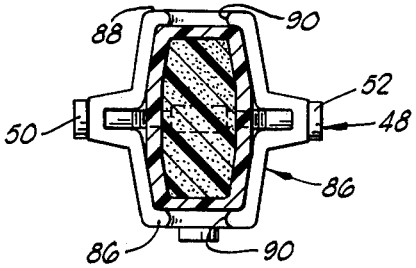
FIG. 10 is a sectional view taken along line 10—10 of FIG. 8.

FIGS. 8–10 of the drawings show yet another modified form of the invention. In this embodiment, the support post 10 and ground post 14 are interconnected by a sleeve 84 in which post-receiving slots are formed in both the back wall 86 and the front wall 88 of the sleeve, as shown in FIGS. 8 and 10. The slots in these walls of the sleeve 84 are identical, and each includes a neck portion 90 having a relatively small transverse width and an enlarged central portion 92 joined to the neck portion by tapered side edges of the slot. As contrasted with the slot formed in the back wall 62 of the embodiments of the invention shown in FIGS. 6 and 7, the slots in the back and forward walls, 86 and 88 respectively, of the embodiment shown in FIG. 8 terminate at a bottom 94 of each of these slots which is spaced upwardly from the lower end of the sleeve 84. A pivot pin subassembly 48 of the type hereinbefore described is utilized for retaining the support post 10 in the sleeve 84 for pivotation about a horizontal axis.

The embodiment of the delineator post assembly of the invention shown in FIGS. 8–10 is especially well suited for use in marking center medians on a divided highway, since the support post 10 is free to pivot downwardly from its upright position in either of two directions as shown in FIG. 9. Thus, when the support post 10 is struck by a vehicle from either direction of travel along the divided highway, it can yield through pivotation into either one of the opposed slots formed in both the back wall 86 and the front wall 88 of the delineator post assembly.

Figure 11:
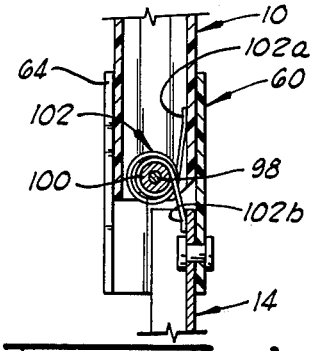
FIG. 11 is a sectional view in a vertical plane through the center of a portion of another embodiment of the invention.

In FIG. 11 of the drawings, yet another embodiment of the invention is illustrated in part, and depicts an arrangement in which an internal, high strength spring is utilized to provide sufficient resilient bias to automatically return the support post to its upright position after it has been displaced by impact. As in the other illustrated embodiments, the ground post 14 is connected to a support post 10 by means of a slotted sleeve 60 of the type illustrated, in FIGS. 6 and 7. It should be pointed out, however, that the sleeve utilized can also be a sleeve of the sort illustrated in FIGS. 1–5, and there denominated by reference numeral 12.

The support post 10 is pivotally supported in the sleeve 60 by means of a pivot pin subassembly of the sort previously described which includes a pivot pin 98 extending through the interior of the support post 10. The pivot pin 98 has mounted thereon a large bushing or sleeve 100 which functions to support a stacked coil spring 102 which is coiled in superimposed convolutions around the outer periphery of the sleeve. The stacked coil spring terminates in one upwardly extending leg **102*a* which bears against the internal surface of one wall of the support post 10. The second end of the spring 102 is at the terminus of another elongated downwardly extending leg 102*b* which bears against the back wall of the ground post 14**.

It will be noted that the position of the spring 102 with respect to the support post 10 and ground post 14 is such that as the support post is pivoted downwardly about the pivot pin 98 as a result of impact thereupon, the spring 102 is placed in tension as a result of the pivotation of the leg **102*a* thereof toward the left as the structure is viewed in FIG. 11. Thus, continued downward pivotal movement of the support post 10 through the slot 64 in the sleeve 60 further increases the extent to which the spring 102 is loaded in resilient deformation. The force developed in the loaded spring has found to be such that the depicted arrangement can be utilized for effecting automatic restoration of the support post to its vertically extending position after the momentum of the downward pivoting movement has been arrested, and the restoring action of the spring 102** becomes effective.

Although preferred embodiments of the invention have been herein described in order to advise those skilled in the art of the manner in which the invention should be practiced, and to explain the basic prinicples underlying the invention, various changes and innovations in the described and illustrated structure can be effected without departure from the basic principles which underlie the invention. Changes and innovations of this type are therefore deemed to be circumscribed by the spirit and scope of the invention, except as the same may be necessarily limited by the appended claims or reasonable equivalents thereof.

What is claimed is:

1. An articulated delineator post assembly for engagement with a vertical ground post having an angulated cross-sectional configuration comprising:

a sleeve having two opposed open ends and including resilient, angulated walls defining a chamber configured to register with, and slidingly receive, an end portion of said ground post, and further including wall means having an elongated slot in one side thereof;

means interlocking said sleeve and ground post against movement relative to each other; and an elongated indicator support post telescoped into the opposite end of said sleeve from the end adapted to slidingly receive said ground post; and means pivotally connecting said indicator support post in said sleeve for pivotation about a horizontal axis and through said elongated slot, said indicator support post having a greater thickness than said slot whereby said wall is resiliently deformed by the extension of said indicator post through said slot upon pivotation of the indicator post.

2. An articulated delineator post assembly as defined in claim 1 wherein said sleeve comprises a tubular member which includes:

a first substantially planar side wall;

second side wall means on the opposite side of said sleeve from said first wall and defining said elongated slot extending the length of said sleeve; and a pair of opposed, interiorly channeled side walls interconnecting said first side wall and said second side wall means and resiliently yieldable to facilitate enlargement of the width of said slot to accommodate pivotal movement of said indicator support post.

3. An articulated delineator post assembly as defined in claim 2 wherein said indicator support post comprises a hollow tubular member having:

a first pair of opposed side walls bearing against said opposed, interiorly channeled side walls; and a second pair of opposed side walls bearing against said first, substantially planar side wall and said second side wall means.

4. An articulated delineator post assembly as defined in claim 3 wherein said first pair of opposed side walls of said hollow tube converge toward each other from the center of said hollow tube in the direction of said second side wall means whereby said resiliently yieldable side walls of said tubular member exert a wedging bias upon said hollow tube when said tube is pivoted partially into said slot to a position where the edges of said second side wall means adjacent said slot bear against said convergent portions of said first pair of opposed side walls.

5. An articulated delineator post assembly as defined in claim 3 wherein said tube is further characterised in including an end portion inside said tubular member and adjacent said pivotal connecting means, and said end portion includes a cut-away relieved corner facilitating the pivotation of said tube in said tubular member and about said horizontal axis.

6. An articulated delineator post assembly as defined in claim 2 and further characterized as including:

elongated, protuberant portions of generally U-shaped cross-section projecting outwardly from central portions of the opposed side walls of said tubular member and extending substantially parallel to said slot, said protuberant portions each defining an interior channel within said tubular member; and wherein said pivotal connecting means comprises a pivot pin assembly extending through said protuberant portions and through said elongated indicator support post.

7. An articulated delineator post assembly as defined in claim 6 wherein said interlocking means, said protuberant portions and said channels are adapted to cooperate in preventing both rotational and longitudinal sliding movement of said sleeve relative to said support post.

8. An articulated delineator post assembly as defined in claim 4 wherein said tube is further characterized in including an end portion inside said tubular member and adjacent said pivotal connecting means, and said end portion includes a cutaway relieved corner facilitating the pivotation of said tube in said tubular member and about said horizontal axis.

9. An articulated delineator post assembly as defined in claim 8 and further characterized as including:

elongated, protuberant portions of generally U-shaped cross-section projecting outwardly from central portions of the opposed side walls of said tubular member and extending substantially parallel to said slot, said protuberant portions each defining an interior channel within said tubular member; and wherein said pivotal connecting means comprises a pivot pin assembly extending through said protuberant portions and through said elongated indicator support post.

10. An articulated delineator post assembly as defined in claim 9 wherein said interlocking means, said protuberant portions and said channels are adapted to cooperate in preventing both rotational and longitudinal sliding movement of said sleeve relative to said suppprt post.

11. An articulated delineator post assembly for engagement with a ground post comprising:

an elongated indicator support post;

a slotted sleeve assembly slidably retained in contact with said indicator support post and adapted for engagement with said ground post; and pivotal connecting means securing said resilient indicator support post to said sleeve assembly for pivotation about a horizontal axis and through the slot in said sleeve assembly.

12. An articulated delineator post assembly as defined in claim 11 wherein said indicator support post is an elongated resilient tubular member.

13. An articulated delineator post assembly as defined in claim 11 wherein said sleeve assembly comprises a generally tubular member including:

a slotted side; and additional sides collectively forming a hollow interior, and including two opposed sides having elongated lobes therein extending parallel to said slot and projecting outwardly from said sleeve.

14. An articulated delineator post assembly as defined in claim 11 wherein said slotted sleeve assembly is further characterized in including a sleeve telescopingly engaged with said ground post and including a portion projecting upwardly from said ground post and having a pair of opposed slots therein on opposite sides of the sleeve for receiving said indicator support post when said support post is pivoted in either of two opposite directions from the vertically extending position and about said horizontal axis.

15. an articulated delineator post assembly as defined in claim 11 wherein said slotted sleeve assembly is further characterized in including resilient spring means connected to said pivotal connecting means and bearing against said support post to resiliently bias said support post toward a vertical position in which said support post is aligned with said ground post.

16. an articulated delineator post assembly as defined in claim 11 wherein said slotted sleeve assembly includes a generally tubular resilient sleeve having at least one slot formed in a side of the sleeve, with said slot including a neck portion opening at the upper end of the tubular sleeve and having a width insufficient to receive said support post when the support post is pivoted therethrough except upon resilient deformation of the sleeve to facilitate widening of the slot, and further having a central portion positioned below and in communication with the neck portion, said central portion of the slot having a width larger than the neck portion of the slot for at least partially relieving the deformation of the sleeve after said support has pivoted through said neck portion to a position of extension through said central portion.

17. An articulated delineator post as defined in claim 16 wherein said slotted sleeve assembly is further characterized in including resilient spring means connected to said pivotal connecting means and bearing against said support post to resiliently bias said support post toward a vertical position in which said support post is aligned with said ground post.

18. An articulated delineator post assembly as defined in claim 17 wherein said pivotal connecting means comprises a pair of opposed pivot pins each having a portion projecting outwardly from the sleeve; and said spring means includes convolutions encircling each of said pivot pins outside of said sleeve; and a bight portion bearing agains said support post.

19. An articulated delineator post assembly as defined in claim 16 wherein said sleeve is further characterized in having a pair of said slots positioned in opposite sides of said resilient sleeve.

20. A highway delineator post structure comprising:

an elongated ground post having, in cross-section:

a U-shaped central portion; and a pair of flanges projecting in opposite directions from said U-shaped central portion;

a slotted tubular sleeve including:

a first wall;

a longitudinally slotted wall opposite said first wall; and a pair of spaced, longitudinally lobed side walls joining said first wall and said longitudinally slotted wall, said lobed walls each having a lobe projecting outwardly from said tubular sleeve, and each slidingly receiving one of the flanges of said ground post;

means interlocking said sleeve in telescoping engagement with said ground post with said flanges in said interior channels;

a polygonally cross-sectioned elongated indicator support post having an end portion telescoped into said sleeve, and extending in axial alignment with said ground post; and means pivotally engaging said sleeve and said indicator support post for pivotation of the indicator support post about a horizontal axis, and for extension of the support post, upon pivotation from the pivotal axis thereof, through the slot in said slotted wall.

21. A highway delineator post structure as defined in claim 20 wherein said tubular sleeve is constructed of a resilient synthetic resin.

22. A highway delineator post structure as defined in claim 21 wherein the cross-sectional geometries of said sleeve and said support post are cooperatively related to provide a resiliently biasing force acting upon said support post to pivot said support post from a position in which it is partially in said slot and at an acute angle to the vertical to a position in which said support post is entirely out of said slot and extends vertically.

* * * * *

UNITED STATES PATENT OFFICE

CERTIFICATE OF CORRECTION

Patent No. 4,032,248 Dated June 28, 1977

Inventor(s) Alfred P. Parduhn and Waldo E. Cecil

It is certified that error appears in the above-identified patent and that said Letters Patent are hereby corrected as shown below:

Column 1, line 26, change "ben" to --been-- ;

Column 1, line 66, change "an" to --any-- ;

Column 1, line 41, change "uper" to --upper-- ;

Column 5, line 52, change "joind" to --joined-- ;

Column 5, line 64, before "ground" insert --sleeve on the-- ;

Column 8, lines 11-12, change "vertically" to --verticality-- ;

Column 10, line 63, change "prinicples" to --principles-- ;

Column 12, line 41, change "suppprt" to --support-- ;

Column 13, line 5, capitalize the word "an" ;

Column 13, line 12, capitalize the word "an" ;

Column 13, line 44, change "agains" to --against-- .

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*